US006076260A

United States Patent [19]

Williamson, IV

[11] Patent Number: 6,076,260

[45] **Date of Patent: *Jun. 20, 2000**

[54] CIGAR CLIPPER AND METHOD

[75] Inventor: Warren P. Williamson, IV, Loveland, Ohio

[73] Assignee: Amyx & Christy, Inc., Winter Park, Fla.

[ * ] Notice: This patent issued on a continued prosecution application filed under 37 CFR 1.53(d), and is subject to the twenty year patent term provisions of 35 U.S.C. 154(a)(2).

[21] Appl. No.: 08/982,697

[22] Filed: Dec. 2, 1997

Related U.S. Application Data

[60] Provisional application No. 60/031,547, Dec. 2, 1996.

[51] Int. Cl.[7] ..... A24C 5/12

[52] U.S. Cl. ..... 30/113; 30/304; 30/279.2

[58] Field of Search ..... 30/111, 113, 232, 30/241, 356, 221, 304, 279.2

[56] References Cited

U.S. PATENT DOCUMENTS

| | | | |
|---|---|---|---|
| Re. 13,873 | 2/1915 | Emrich | 30/113 |
| 715,315 | 12/1902 | Steinecke | 30/113 |
| 837,018 | 11/1906 | Wentz | 30/113 |
| 975,575 | 5/1910 | Pryor, Jr. | 30/113 |
| 1,061,236 | 5/1913 | Puller | 30/113 |
| 1,066,365 | 7/1913 | Battin | 30/113 |
| 1,082,257 | 12/1913 | Astruck | 30/113 |
| 1,119,220 | 12/1914 | Bates | 30/113 |
| 3,903,598 | 9/1975 | Lefebvre . | |
| 4,027,682 | 6/1977 | Halmaghi . | |
| 4,182,234 | 1/1980 | Reed . | |
| 5,535,763 | 7/1996 | Conte . | |
| 5,715,602 | 2/1998 | Hage | 30/113 |

*Primary Examiner*—Rinaldi I. Rada
*Assistant Examiner*—Kim Ngoc Tran
*Attorney, Agent, or Firm*—Terry M Gernstein

[57] ABSTRACT

A clipper for cutting an end from a cigar preparatory to smoking the cigar includes a pair of relatively slidable body sections, each of which has an opening at an outer end dimensioned to permit a finger to pass thereinto and a pair of slide rails disposed along the sides. Two opposed cutouts at the inner ends form a body hole, into which extend a pair of opposed blade edges, which each also have opposed cutouts that form a cutting hole. The body sections are slidable between an admitting position for placing the cigar end into the cutting hole and a cutting position wherein the blade cutouts obscure the cutting hole, thereby clipping the end from the cigar. A depression is provided for resting the cigar therein when not being smoked, and finger notches

20 Claims, 6 Drawing Sheets

FIG. 9.
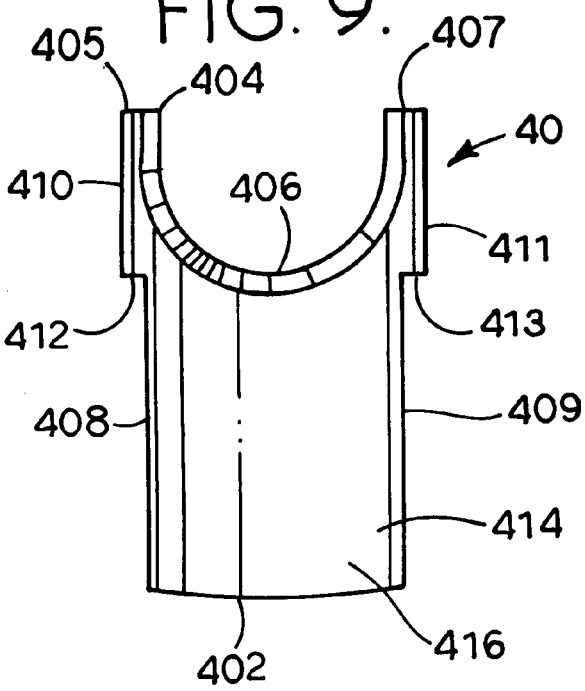
FIG. 10.
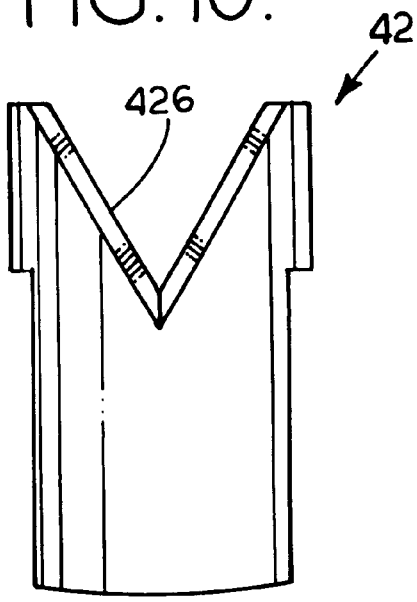
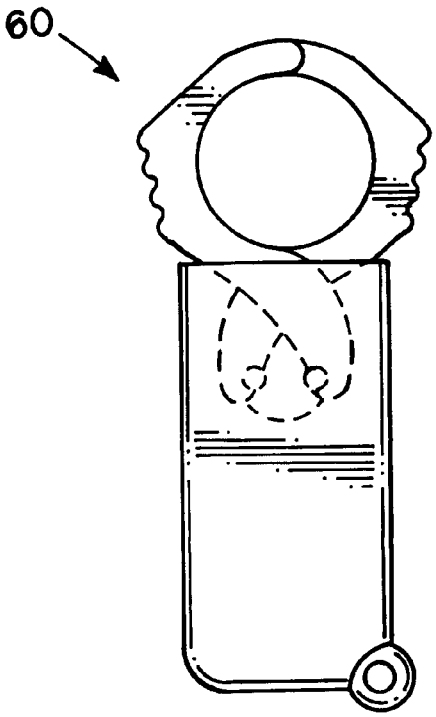
FIG.11A.
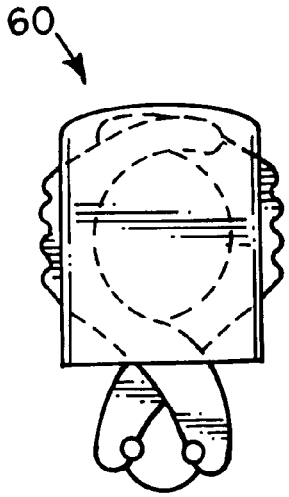
FIG. 11B.

CIGAR CLIPPER AND METHOD

CROSS-REFERENCE TO RELATED APPLICATION

This application claims priority from provisional application Ser. No. 60/031,547, "Cigar Clipper and Method," filed Dec. 2, 1996.

BACKGROUND OF THE INVENTION

1. Field of the Invention

The present invention relates to devices and methods for cutting an end from a generally cylindrical object, and, more particularly, to devices and methods for cutting an end from a rolled tobacco product.

2. Description of Related Art

Cigar smoking has recently gained significant popularity in the United States and around the world, and the accessories that accompany cigar smoking have made attendant gains.

Preparing the end of the cigar, which comprises cutting a hole in the cap, is a ritual that may take on many styles. This preparation is necessary to draw smoke through the cigar, since the cap prior to the cigar's being smoked serves to hold the wrapper and thus the cigar together.

It has been a common practice to bite a hole in the cap, which can allow the cigar to unravel. More sophisticated connoisseurs prepare the end with the use of a punch, clipping or cutting. Known clipping products include: a scissors-type device; a guillotine-style cutter, which is one angled blade made of razor blade material; and a self-sharpening double-blade device.

Several devices for facilitating the operation have been disclosed in the patent literature, among which are embodied in U.S. Pat. Nos. 3,903,598 to Lefebvre, 4,027,682 to Halmaghi, and 5,535,763 to Conte.

SUMMARY OF THE INVENTION

It is therefore an object of the present invention to provide an improved cigar clipper and method of using same.

It is another object to provide such a clipper that can serve as a cigar rest.

It is a further object to provide such a clipper that has an improved ergonomic feel and a contoured shape.

It is an additional object to provide such a clipper that has improved controllability.

These and other objects are achieved by the device and method of use of the present invention. The clipper, which is for cutting an end from a cigar preparatory to smoking the cigar, comprises two separable and slidably engagable body sections.

The first body section has a first opening at an outer end that is dimensioned to permit a finger to pass thereinto. A first pair of engaging means is positioned so that one engaging means is disposed along a first and a second side of the first body section, There is a first cutout at an inner end and a first depression between the first pair of engaging means and inward of the first opening.

Similarly, the second body section has a second opening at an outer end that is dimensioned to permit a finger to pass thereinto. A second pair of engaging means is positioned so that one engaging means is disposed along a first and a second side of the second body section. The second pair of engaging means is adapted to slidingly engage the first pair of engaging means. There is a second cutout at an inner end, the first and the second cutouts defining a body hole when the first and the second body sections are engaged. There is additionally a second depression between the second pair of engaging means and inward of the second opening.

The cutter further comprises a first and a second blade. The first blade is adapted to reside within the first depression, and the second blade is adapted to reside within the second depression. Each blade has a sharp inner edge that is contoured and dimensioned to permit an end of a cigar to fit thereinto. Each blade also has a length sufficient to permit at least a portion of the inner edge to protrude into its respective cutout when positioned within its respective depression. The inner edges thereby define a cutting hole.

The cutter elements are dimensioned so that, when engaged, the first and the second body sections are slidable between a first position for admitting a cigar end, wherein the blade inner edges are in spaced relation, and a second position for cutting the cigar end, wherein the inner edges of the blades are closely opposed.

The method of operation of the cigar cutter of the present invention is to insert a thumb into the first opening and a finger, typically a first or middle finger, into the second opening. Pressure is exerted outwardly to separate the first and the second body sections sufficiently far to permit the cigar end to be clipped to be inserted into the cutting hole.

Next pressure is exerted inwardly to bring the first and the second body sections sufficiently close together that the blades, inner edges slice through the cigar end and cut it away from the rest of the cigar.

The features that characterize the invention, both as to organization and method of operation, together with further objects and advantages thereof, will be better understood from the following description used in conjunction with the accompanying drawing. It is to be expressly understood that the drawing is for the purpose of illustration and description and is not intended as a definition of the limits of the invention. These and other objects attained, and advantages offered, by the present invention will become more fully apparent as the description that now follows is read in conjunction with the accompanying drawing.

BRIEF DESCRIPTION OF THE DRAWINGS

FIG. 9 is a top plan view of a clipper blade.

FIG. 10 is a plan view of an alternate embodiment of the clipper blade.

FIG. 11A is a plan view of an alternate embodiment of the cigar clipper in the stowed position.

FIG. 11B is a plan view of the alternate embodiment of the cigar clipper in the open position.

DETAILED DESCRIPTION OF THE PREFERRED EMBODIMENTS

A description of the preferred embodiments of the present invention will now be presented with reference to FIGS. 1–11B.

Figure 1:
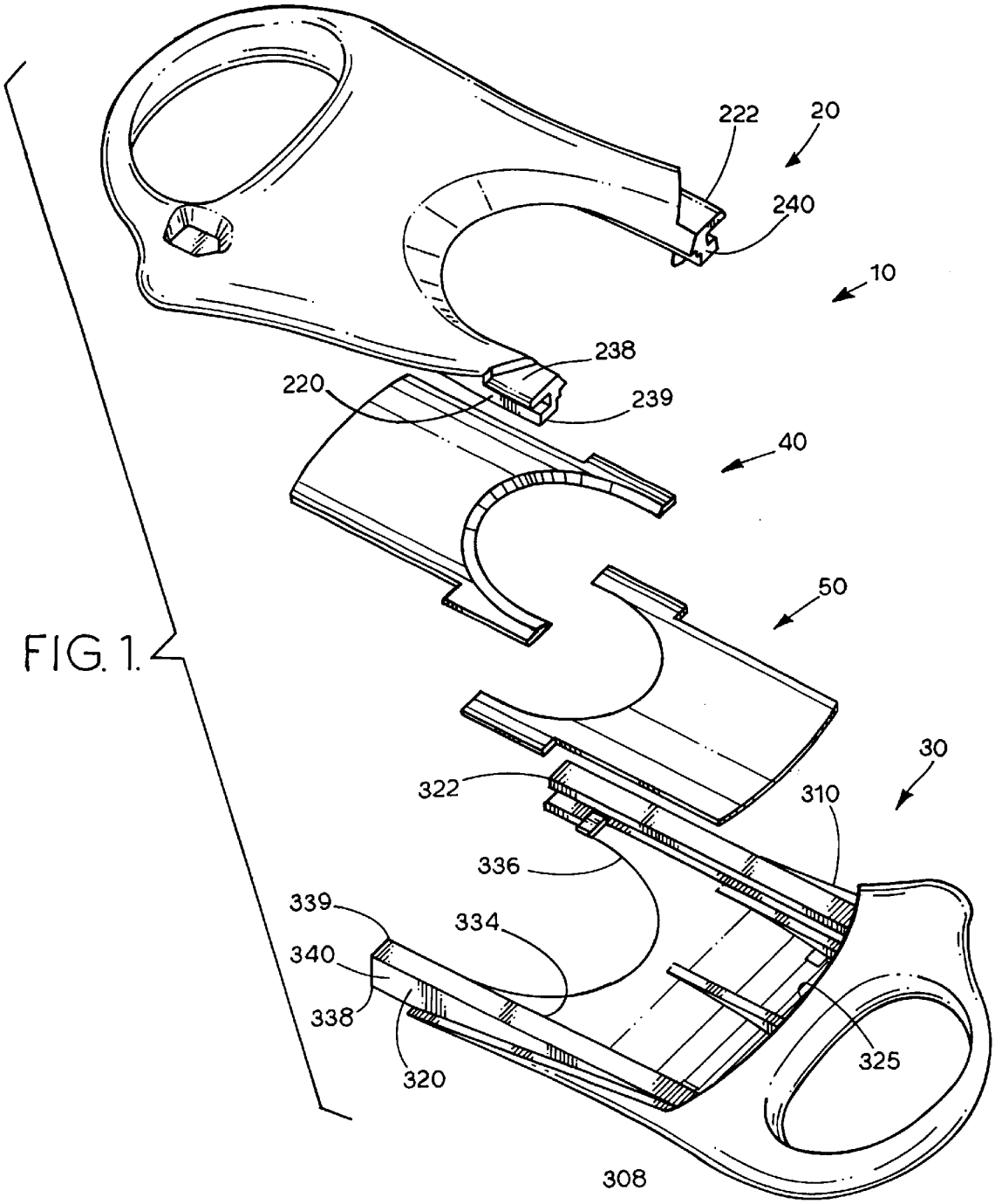
FIG. 1 is an exploded view of the cigar clipper of the present invention.
Figure 2:
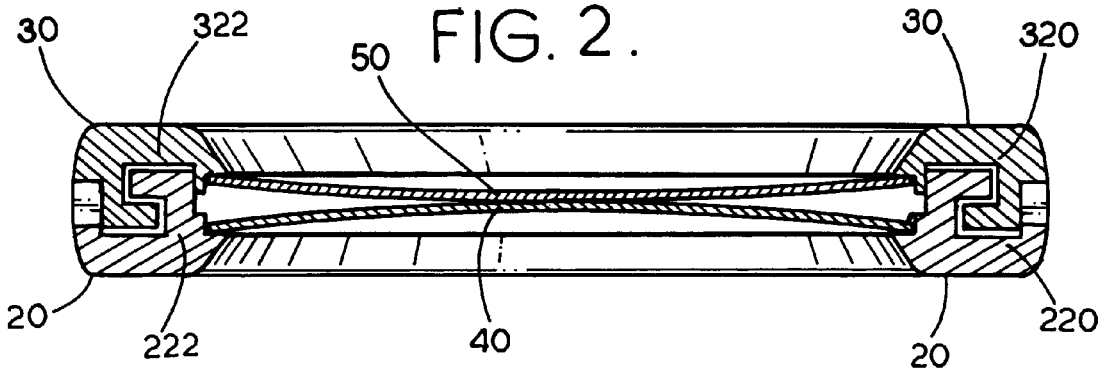
FIG. 2 is a cross-sectional view of the cigar clipper taken along the line A–A' in FIG. 3B.
Figure 3A:
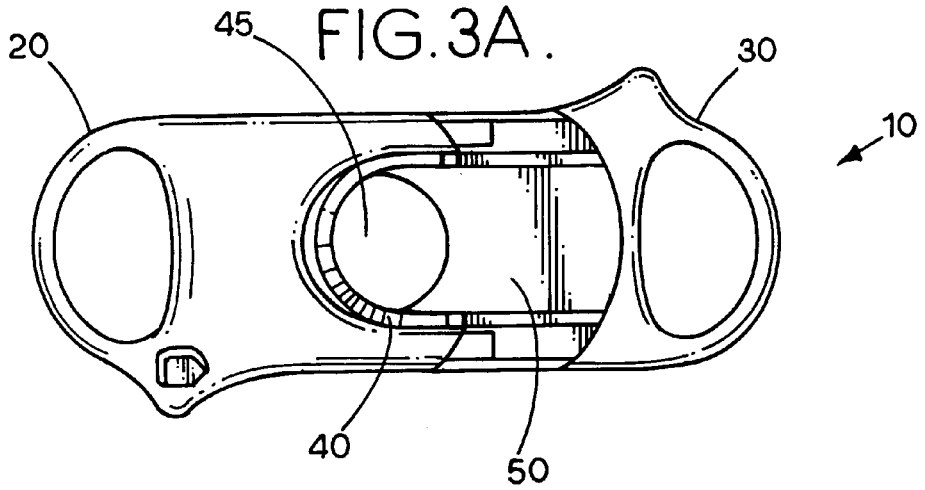
FIG. 3A is a top plan view of the assembled cigar clipper in the admitting position.
Figure 3B:
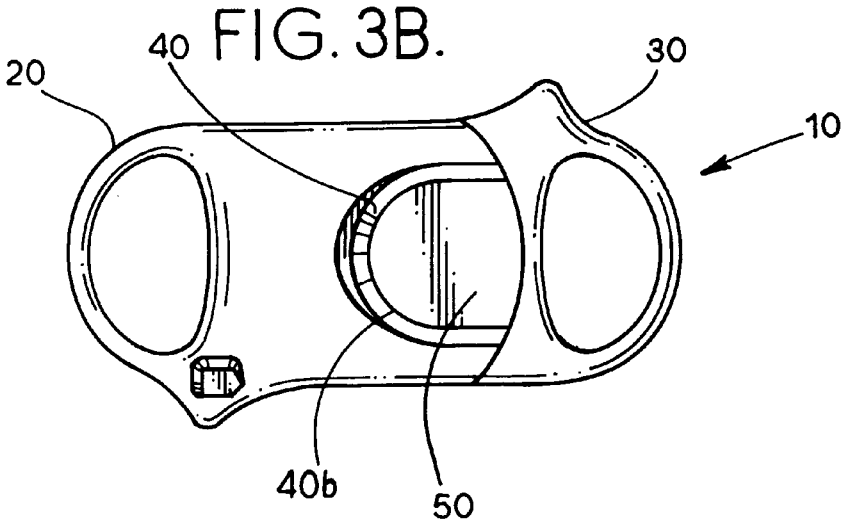
FIG. 3B is a top plan view of the assembled cigar clipper in the cutting position.
Figure 4:
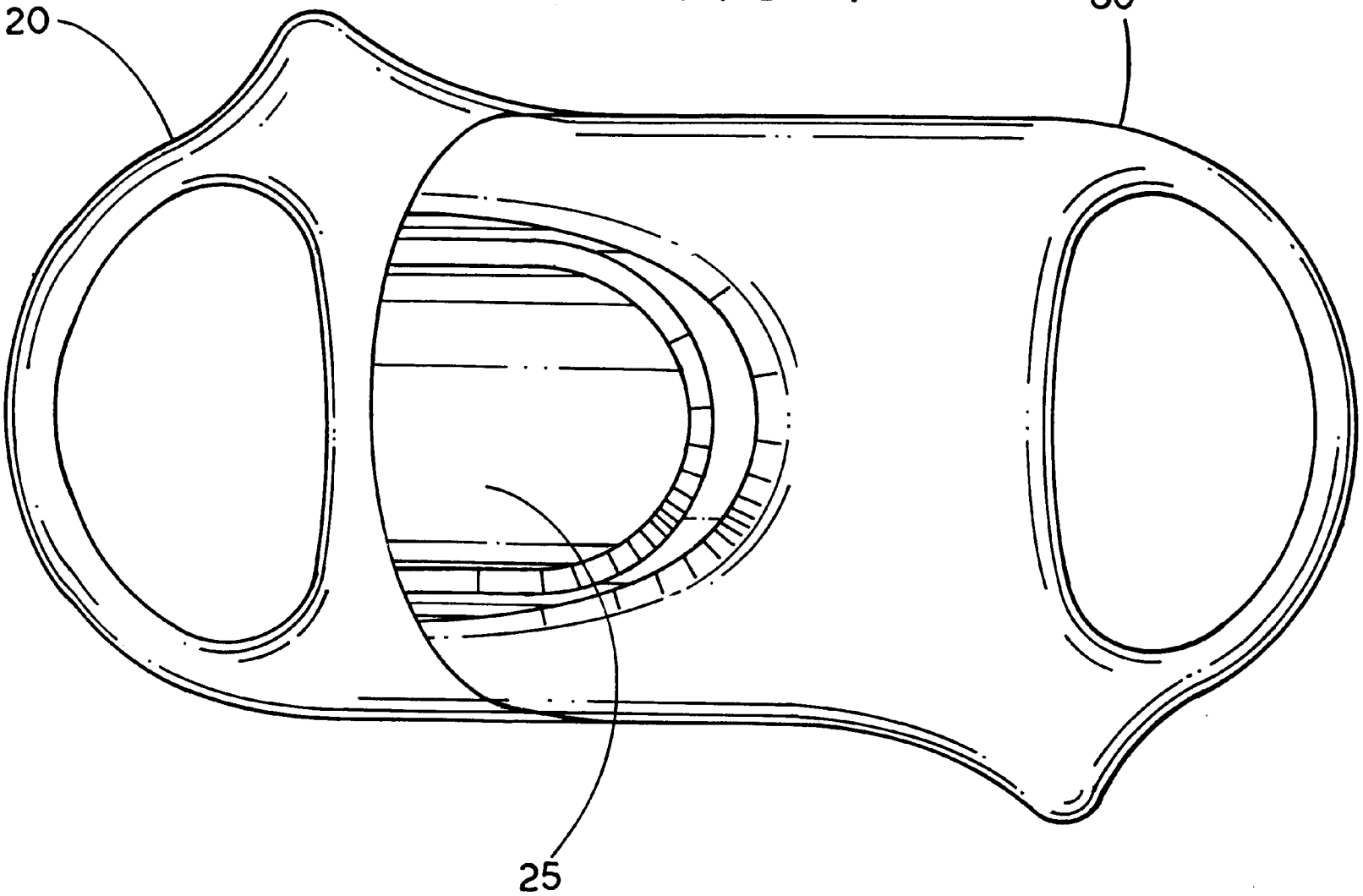
FIG. 4 is a perspective top plan view of the assembled cigar clipper body.
Figure 6:
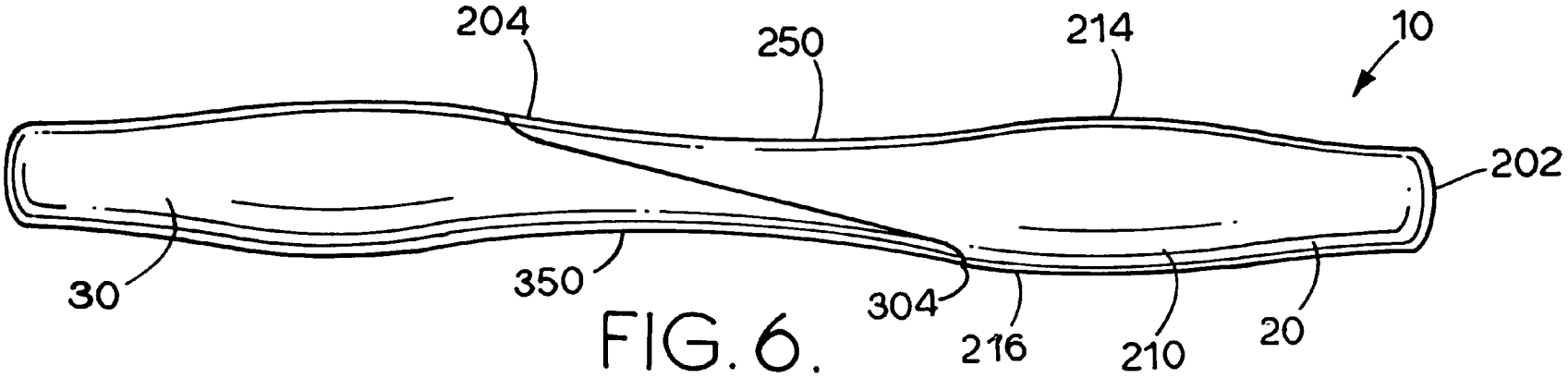
FIG. 6 is a perspective side view of the assembled cigar clipper.
Figure 5:
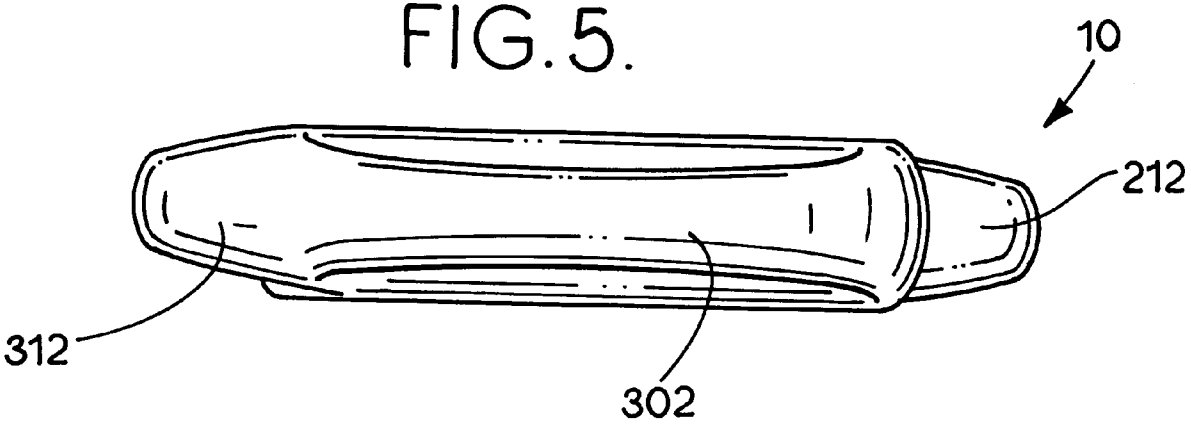
FIG. 5 is a perspective end view of the assembled cigar clipper.

A first embodiment of the clipper 10, which is shown assembled in FIGS. 3A and 3B, in exploded view in FIG. 1, in cross section in FIG. 2, in end view in FIG. 5, and in side view in FIG. 6, comprises two body sections 20,30 and two blades 40,50.

Figure 7:
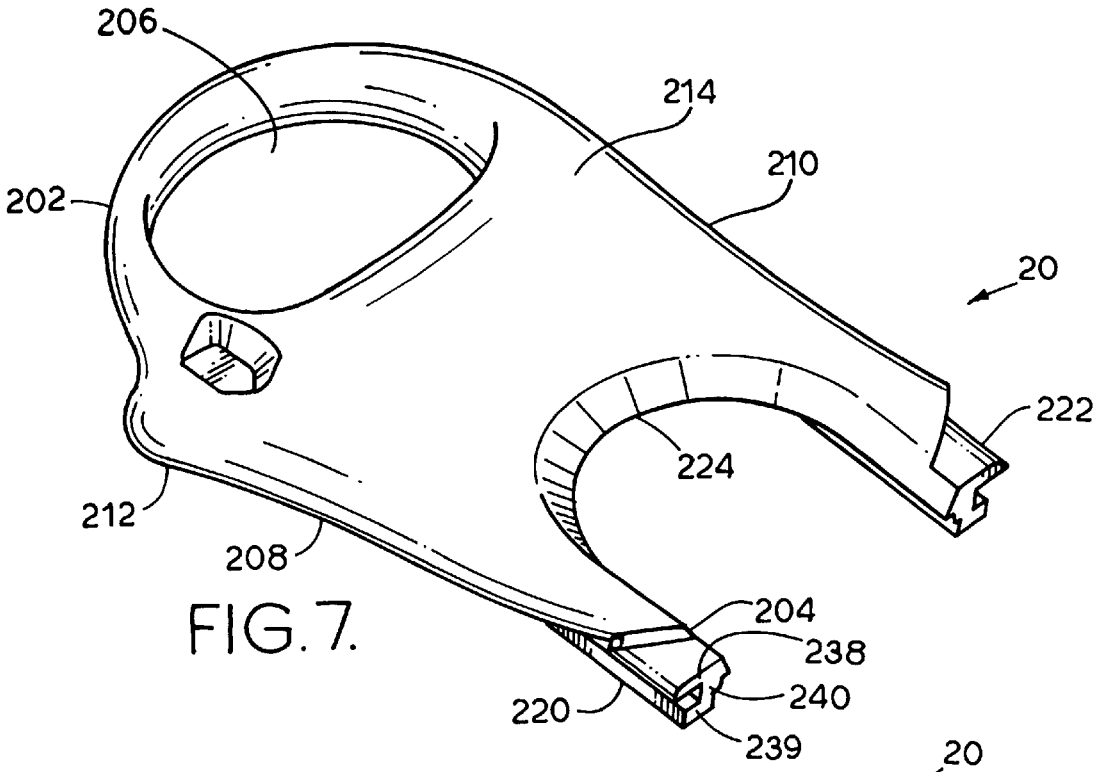
FIG. 7 is a perspective view of the top surface of one section of the cigar clipper body.
Figure 8:
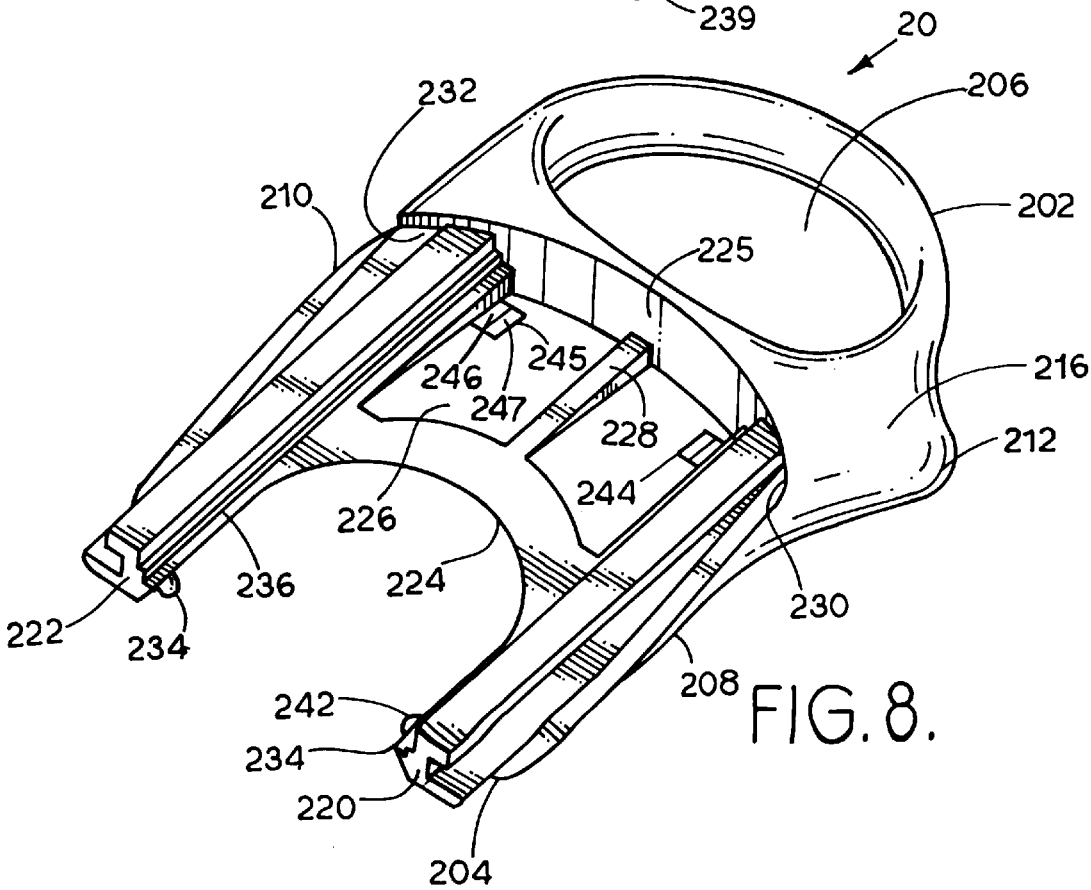
FIG. 8 is a perspective view of the bottom surface of one section of the cigar clipper body.

The first body section 20 is illustrated in FIGS. 7 and 8. The second body section 30 is a mirror image of the first body section 20, and thus will not be described in detail. Note that "top" and "bottom" are reversed when the device is assembled.

First body section 20 has an outer end 202 that has an outward curvature. Adjacent the outer end 202 is a first opening 206 that is dimensioned to permit a finger to pass thereinto. Extending from the first side 208 is first protrusion 212, which is dimensioned to permit a finger to rest thereagainst for providing stability and leverage during use, as will be discussed in the following. The inner portion of first side 208 is generally straight in plan view until it meets the inner end 204. The second side 210 in plan view is generally straight until it meets the inner end 204. Viewed from the side (FIG. 6), each side surface has a first width adjacent the outer end 202 that tapers from the bottom surface 216 to the top surface 214 to a point at the inner end 204. In addition, the top surface 214 has a lateral depression 250 (see FIG. 6) situated between the inner end 204 and the first protrusion 212.

The inner end 204 has a generally centrally located rounded cutout 224. At the ends of the cutout 224, the inner end 204 meets the sides 208,210 in a taper that extends outwardly. The top surface 214 is generally smoothly contoured, the portion leading to the cutout 224 tapering inwardly from the top surface 214 to the bottom surface 216 (see FIG. 7).

The bottom surface 216 (FIG. 8) at the outer end 202 is generally smoothly contoured to just inward of the opening 206 and the first protrusion 212. Adjacent the opening 206 and the first protrusion 212, and between the first and the second sides 208,210, is a first depression 226. The first depression 226 meets the outer portion of the bottom surface 216 at an outer wall 225 that has an outward curvature until meeting the sides 208,210. Extending toward the outer end 202 from the depression's outer wall 225 and along each side 208,210 is a rail hole 230,232, which proceeds between the top 214 and bottom 216 surfaces and ends before reaching the outer end 202. In spaced relation and generally parallel to each of the sides 208,210 is a rail raceway 234,236. Generally centrally located and terminating against the outer wall 225 is center blade brace 228, which protrudes above the inner surface of the first depression 226. In spaced relation to the outer wall 225, and extending toward the center blade brace 228, is a pair of stepped blade side supports 244,245, each having a higher portion 246 abutting the respective side rail 220,222 and a lower portion 247 closer to and in spaced relation to the center blade brace 228.

Extending slightly above the rail raceways 234,236 and generally perpendicularly into and on either side of the cutout 224, adjacent the inner end 204, is a pair of opposed guide protrusions 242,243.

Positioned inside and adjacent each side 208,210, and in spaced relation to each rail raceway 234,236, and further extending from beyond the inner end 204 to within each rail hole 230,232, is a slide rail 220,222. Each slide rail 220,222 is an elongated member having an outer arm 238 having a first width, an inner arm 239 having a second width smaller than the first width, and a connecting arm 240 generally perpendicular to the outer 238 and inner 239 arms, forming a generally squared C-shaped structure in cross section, positioned so that the open jaw of each of the rails 220,222 faces away from the cutout 224.

Assembling the body sections 20,30 (see FIGS. 1, 4, and 6) is achieved by opposing the inner ends 204,304 and inserting the slide rails' inner arms 239,339 into the space formed by the opposing inner 239,339 and outer 238,338 arms. In order to achieve sliding engagement, the respective guide protrusions 242,243 must be forced past each other. Preferably these protrusions 242,243 are dimensioned so that only a small amount of force is required to engage the slide rails 220,222,320,322, but that there is a sufficient barrier to disengagement that the two body sections 20,30 will not separate without a pulling action. Thus engaged, the slide rails 220,222,320,322 are relatively slidable, with each connecting arm 240,340 riding within the space between the edges of the inner 239,339 and outer 238,338 arms and the rail raceways 234,236,334,336. In addition, each guide protrusion 242,243 rides partially atop a respective raceway 234,236.

Sliding motion is stopped when the inner end 204 adjacent the respective sides 208,210 abut against the side portions of the opposing depression's outer wall 325 and the tapered sides 308,310, and similarly for the opposite surface.

Once engaged, the first and the second body sections' cutouts 224,324 form a body hole 25, the size of which is determined by the relative sliding of the first 20 and second 30 body sections.

The cutter 10 further comprises a first 40 and a second 50 blade. The first blade 40 is adapted to reside within the first depression 226, and the second blade 50 is adapted to reside within the second depression (not shown). In a preferred embodiment, the two blades 40,50 are substantially identical; first blade 40 is illustrated in top plan view in FIG. 9.

Each blade 40 has an outwardly curving outer edge 402 that is contoured to closely engage the central portion of a body section's outer wall 225. Substantially parallel side edges have an outer portion 408,409, meeting a wider inner portion 410,411 at a generally perpendicular shoulder 412, 413.

The blade's inner edge 404 has two opposing narrow portions 405,407 that are generally perpendicular to the side edges' inner portions 410,411. Between the narrow portions 405,407 is an outwardly extending, rounded blade cutout 406. Blade cutout 406 is a sharp edge, and has an inwardly extending taper from the top surface 414 to the bottom surface 416.

In an alternate embodiment (FIG. 10), the blade 42 has a cutout 426 that is "V" shaped.

In a preferred embodiment, the blade 40 has a lateral, upward bow (see FIG. 2). This bowing keeps the blades 40,50 closely opposed during a cutting operation.

Blade 40 is dimensioned to fit within and be supported by various structures in the first body section 20. The length from the outer edge 402 to the inner edge narrow portions 405,407 is dimensioned to fit between and be closely engaged by the depression's outer wall 225 and the guide protrusions 242,243. The length from the outer edge 402 to the blade cutout 406 is dimensioned so that, when assembled, the blade cutout's edge protrudes beyond that of the body section's cutout 224.

The width between the sides' inner portions 410,411 is dimensioned to fit within and be closely engaged by the rail raceways 234,236. The width between the sides' outer portions 408,409 is dimensioned to fit within and be closely engaged by the side supports' higher portions 246.

The blade's top surface 414 is supported by the depression 226, the center blade brace 228, and the side supports, lower portions 247.

When assembled, with the body sections 20,30 engaged, the blades' cutouts 406,506 form a cutting hole 45 that is adjustable in size by sliding the body sections 20,30 relative to each other.

The cutting hole 45 should have a maximum size in the admitting position (FIG. 3A) at least sufficiently large to admit the end of a cigar and a minimum size in the cutting position (FIG. 3B) wherein the edges 406,506 overlap for complete cutting.

An additional useful feature of the cutter 10 is as a cigar holder. When placed atop a surface with the top and bottom surfaces generally horizontal, the lateral depression 250 (or its counterpart 350, depending upon the orientation of the device) can support the body of a cigar, with the lighted end extending away from the cutter 10. This feature is advantageous in eliminating the need for an ashtray.

The cutter 10 is typically operated by inserting a thumb into the second body section's opening 306 and inserting a middle finger into the first body section's opening 206, resting the first finger against the first protrusion 212. The body sections 20,30 are then manipulated into the admitting position by separating the thumb and middle finger until a desired cutting hole size is achieved for inserting the cigar end thereinto. While holding the cigar with the opposite hand, the thumb and middle finger are brought together until the cutter 10 is in the cutting position and the cigar end, comprising a portion of the cap, is clipped.

In an exemplary embodiment the weight of the device 10 is approximately 2.75 oz, which enables easy portability but is sufficiently heavy to impart substance. The body section material preferably comprises a plastic that has been filled with a filling material adapted to generate additional weight. Such a filling material may comprise, but is not intended to be limited to, stainless steel, tungsten, lead, fiberglass, or marble. The surface texture is preferably matte black. The length in the closed position is approximately 3.6 in. and 4.4 in. in the admitting position. The width is approximately 0.4 in. maximum, and the cutting hole 45 is a 19-mm oblong. The blades 40,50 are coated with titanium nitride, which is advantageous for durability and maintaining sharpness. The cutter 10 is highly ergonomic, enabling the user to control the cut and feel comfortable during the process. The operation of the cutter 10 is self-explanatory, unlike some prior art devices, and the tight tolerances provide a precision feel. The bowing of the blades 40,50 provides a self-sharpening feature that extends the life of the cutter 10. The design further permits the blade interaction to be so sharp that the cigar does not compress prior to cutting. In addition, when in the cutting position, the cutter 10 will not open without intent of the user.

An alternate embodiment of the invention 60 comprises a pair of movable jaws that are extendable and retractable between a stowed position (FIG. 11A) for easy and safe portability and an open position (FIG. 11B) for use. This embodiment 60 is adapted, for example, for carrying on a keychain, although this method of use is not intended as a limitation.

It may be appreciated by one skilled in the art that additional embodiments may be contemplated, including alternate sliding arrangements and blade designs.

In the foregoing description, certain terms have been used for brevity, clarity, and understanding, but no unnecessary limitations are to be implied therefrom beyond the requirements of the prior art, because such words are used for description purposes herein and are intended to be broadly construed. Moreover, the embodiments of the apparatus illustrated and described herein are by way of example, and the scope of the invention is not limited to the exact details of construction.

Having now described the invention, the construction, the operation and use of preferred embodiment thereof, and the advantageous new and useful results obtained thereby, the new and useful constructions, and reasonable mechanical equivalents thereof obvious to those skilled in the art, are set forth in the appended claims.

What is claimed is:

1. A cigar cutter comprising:

A) two frames;

B) rails on each frame slidably engaging each other each frame can slide toward and away from the other frame;

C) a cigar cutting blade releasably located on each frame, each blade including a distal end, a proximal end, lateral side edges, a longitudinal centerline extending parallel to said lateral edges from said distal end to said proximal end, a cutting edge on said distal end and which extends between said lateral edges across said longitudinal centerline and which is oriented to co-operate with the cutting edge on the blade on the other frame when the frames are moved toward each other to clip a cigar located between the blades; and D) each blade being curved around said longitudinal centerline to be non-planar and convex with respect to the other blade with the convex surfaces of the two blades being in sliding contact with each other said blades being in sliding contact with each other when the frames are moved toward and away from each other whereby both cutting edges are held in contact with each other during a cigar cutting operation for the entire cutting operation.

2. The cigar cutter defined in claim 1, wherein each of the frames includes a depression defined therein to extend between the rails thereon from an inner edge of each rail into a central region, the depression dimensioned and shaped to house a blade therein with the cutting edge protruding from the depression.

3. The cigar cutter defined in claim 1 wherein the cutting edge of each blade is arcuate.

4. The cigar cutter defined in claim 1 wherein each frame is curved and shaped to hold a cigar thereon.

5. The cigar cutter defined in claim 1 further including means on each frame for supporting the blade thereon against movement lateral to the blade.

6. The cigar cutter defined in claim 5 wherein the means for supporting the blades against lateral movement includes shoulders on the blades abutting corresponding shoulders on the frames.

7. The cigar cutter defined in claim 5 wherein each frame includes a brace element that engages the blade thereon.

8. The cigar cutter defined in claim 1 further including means on each frame for preventing separation of one frame from slidable engagement with the other frame.

9. The cigar cutter defined in claim 1 wherein each frame is molded.

10. The cigar cutter defined in claim 1 wherein each frame further includes a finger support thereon.

11. The cigar cutter defined in claim 1 further including a portion of each frame engaging the blade thereon adjacent to the cutting edge for the entire length of the cutting edge for foreceably holding the blades in engagement with each other adjacent to the cutting edges.

12. The cigar cutter defined in claim 11 wherein each cutting blade is beveled adjacent to the cutting edge on the convex side thereof.

13. A cigar cutter comprising:

A) two frames;

B) rails on each frame slidably engaging each other so each frame can slide toward and away from the other frame;

C) a cigar cutting blade releasably and movably located on each frame, each blade including a distal end, a proximal end, two lateral edges, a longitudinal centerline extending parallel to said lateral edges from said distal end to said proximal end, a cutting edge on said distal end and which is oriented to co-operate with the cutting edge on the blade on the other frame to form a point contact when the frames are moved toward each other to clip a cigar located between the blades; and D) each blade being curved around said longitudinal centerline to be non-planar and convex with respect to the other blade with the convex surfaces of each blade being in sliding contact with each other for orienting and maintaining the cutting edge of each blade in a manner such that the cutting edges of the two blades remain in contact with each other when the frames are moved toward and away from each other whereby both cutting edges are held in contact with each other during a cigar cutting operation for the entire cutting operation.

14. A cigar cutter comprising:

A) two frames;

B) rails on each frame slidably engaging each other so each frame can slide toward and away from the other frame;

C) a cigar cutting blade releasably and movably located on each frame, each blade including a proximal end, a distal end and a cutting edge on said distal end and which is oriented to co-operate with the cutting edge on the blade on the other frame to form a point contact when the frames are moved toward each other to clip a cigar located between the blades;

D) each cigar cutting blade including a body having a centerline extending from the cutting edge thereon toward said proximal end, each cutting blade being curved about the centerline thereof to be non-planar and convex with respect to the other blade;

E) means for moving the blades during a cigar cutting operation to maintain the point contact between said cutting edges consisting entirely of the curvature of each blade.

15. A cigar cutter comprising:

A) two frames;

B) rails on each frame slidably engaging rails on the other frame with the frames being slidable toward and away from each other;

C) a cigar cutting blade releasably located on each frame, each blade including (1) a first end, (2) a second end, (3) two side edges extending from said first end to said second end, (4) a longitudinal centerline extending from said first end to said second end, and (5) a cutting edge on said first end and which extends from one of said side edges to the other side edge of said two side edges across said longitudinal centerline and which is oriented to co-operate with the cutting edge on the blade on the other frame when the frames are moved toward each other to clip a cigar located between the blades; and D) each blade being curved around said longitudinal centerline to be non-planar and convex with respect to the other blade with the convex surfaces of the two blades being in sliding contact with each other said blades being in sliding contact with each other when the frames are moved toward and away from each other whereby both cutting edges are held in contact with each other during a cigar cutting operation for the entire cutting operation.

16. The cigar cutter defined in claim 15 wherein each of said cutting edges is arcuate and positioned with respect to the other of said cutting edges to be concave with respect to the other cutting edge.

17. The cigar cutter defined in claim 26 wherein each cutting blade is beveled adjacent to the cutting edge on the convex side thereof.

18. The cigar cutter defined in claim 15 wherein the cutting edge on the first end of each blade extends from adjacent to one of the side edges to adjacent to the other side edge.

19. A cigar cutter comprising:

A) two frames;

B) rails on each frame slidably engaging each other so each frame can slide toward and away from the other frame;

C) a cigar cutting blade releasably located on each frame, each blade including a distal end, a proximal end, a longitudinal centerline extending from said distal end to said proximal end, a cutting edge on said distal end and which extends across said longitudinal centerline and which is oriented to co-operate with the cutting edge on the blade on the other frame when the frames are moved toward each other to clip a cigar located between the blades; and D) each blade being curved around said longitudinal centerline to be non-planar and convex with respect to the other blade with the convex surfaces of the two blades being in sliding contact with each other, said blades being in sliding contact with each other when the frames are moved toward and away from each other whereby both cutting edges are held in contact with each other during a cigar cutting operation for the entire cutting operation.

20. A cigar cutter comprising:

A) two frames;

B) rails on each frame slidably engaging each other so each frame can slide toward and away from the other frame;

C) a cigar cutting blade releasably and movably located on each frame, each blade including a distal end, a proximal end, a longitudinal centerline extending from said distal end to said proximal end, a cutting edge on said distal end and which is oriented to co-operate with the cutting edge on the blade on the other frame to form a point contact when the frames are moved toward each other to clip a cigar located between the blades; and D) each blade being curved around said longitudinal centerline to be non-planar and convex with respect to the other blade with the convex surfaces of each blade being in sliding contact with each other for orienting and maintaining the cutting edge of each blade in a manner such that the cutting edges of the two blades remain in contact with each other when the frames are moved toward and away from each other whereby both cutting edges are held in contact with each other during a cigar cutting operation for the entire cutting operation.

* * * * *